United States Patent [19]

Dietzsch et al.

[11] Patent Number: 4,779,246

[45] Date of Patent: Oct. 18, 1988

[54] ELECTRO-ACOUSTIC TRANSDUCER

[75] Inventors: Klaus Dietzsch; Gottfried Brandenburg; Stephan Overbeck, all of Bocholt, Fed. Rep. of Germany

[73] Assignee: Siemens Aktiengesellschaft, Berlin and Munich, Fed. Rep. of Germany

[21] Appl. No.: 17,981

[22] Filed: Feb. 24, 1987

[30] Foreign Application Priority Data

Mar. 20, 1986 [DE] Fed. Rep. of Germany ..... 3609461

[51] Int. Cl.[4] ..... H04R 217/00

[52] U.S. Cl. ..... 367/157; 367/160; 367/163; 367/165; 310/345; 310/348; 381/190

[58] Field of Search ..... 367/157, 165, 173, 188, 367/160, 161, 163, 174; 310/334, 337, 345, 348, 351, 353, 354; 381/190, 173

[56] References Cited

U.S. PATENT DOCUMENTS

| | | | |
|---|---|---|---|
| 4,063,049 | 12/1977 | Pipitone et al. | 381/190 |
| 4,267,479 | 5/1981 | Kato | 310/348 |
| 4,379,211 | 4/1983 | Joscelyn et al. | 381/190 |
| 4,431,937 | 2/1984 | White | 310/353 |
| 4,626,732 | 12/1986 | Debaisieux et al. | 310/348 |

FOREIGN PATENT DOCUMENTS

| | | |
|---|---|---|
| 3504011 | 8/1986 | Fed. Rep. of Germany . |
| 53-70784 | 6/1978 | Japan . |
| 1293670 | 10/1972 | United Kingdom . |

*Primary Examiner*—Deborah L. Kyle
*Assistant Examiner*—John W. Eldred
*Attorney, Agent, or Firm*—Hill, Van Santen, Steadman & Simpson

[57] ABSTRACT

An electro-acoustic transducer has a transducer plate having a piezo-electric layer attached thereto. The electro-acoustic transucer is clamped between bearing members at an annular edge region which is free of the piezo-electric layer. The piezo-electric layer is provided with electrodes which extend into the annular free region of the transducer plate. At least one of the bearing members has electrically conductive zones which press directly or indirectly against the electrodes and which press against electrical plug elements on a housing for the transducer.

14 Claims, 1 Drawing Sheet

ELECTRO-ACOUSTIC TRANSDUCER

BACKGROUND OF THE INVENTION

This inventionn relates generally to electro-acoustic transducers and, in particular, to a transducer in which a transducer plate carrying a piezo-electric layer is clamped between two bearing members along an annular edge region of the transducer plate.

Piezo-electric transducers are well known in the prior art. In this type of transducer, acoustic pressure causes extremely small deflections of a transducer plate. The transducer plate typically carries a piezo-electric layer in which an electric voltage is created at electrodes connected to opposite sides thereof when the layer is subjected to the acoustic pressure. The electric voltage thereby created is proportional to the acoustic pressure. For example, when sound waves impinge upon the transducer plate and piezo-electric layer, a time varying voltage representative of the sound wave appears on the electrodes of the piezo-electric layer. Inversely, a deflection of the transducer plate can be achieved when an electric voltage is applied across the piezo-electric layer attached to the transducer plate.

Since the electric voltage in the acoustic field is usually an alternating voltage, an electrical connection between the electrodes and the electrical components on a housing for the transducer is subjected to mechanical stresses transmitted from the transducer plate. For this reason, the electrical connection has typically been formed from small electrically conductive bands which are then attached to the electrical components on the housing. As a result of the small thin bands which are required to avoid placing any undue mechanical influence on the transducer plate, the electrical connection is exposed to an increased risk of breaking, which in turn leads to loss of functionability of the transducer. In order to avoid this difficulty, one prior art solution has been to utilize a conductive rubber to establish an electrical connection with electrodes of the piezo-electric layer. The conductor rubber therefore lies immediately against the electrodes. Moreover, the conductive rubber can also function as one of the bearing members which supports the transducer plate. Typically, only one subsection of the bearing member is electrically conductive.

As is known, the frequency behavior of the transducer is directly influenced by the bearing used for the transducer plate. Thus, the type and shape of the bearing member is critical to the operation of the transducer. Thus, the edge region of the transducer plate is generally seated between elastic bearing members of a very specific shape and elasticity. Many years of testing with a great variety of bearing members have lead to the result that a bearing member having two annular, concentric shoulders of elastic material is desirable, these bearing members may comprise triangular trapezoidal cross section.

If conductive rubber were then utilized for contacting the electrodes, the selection of the bearing members is extremely restricted. Furthermore, conductive rubber is generally composed of strip shaped bands. A specific, annular fashioning of such conductive rubber for employment as a bearing member for transducers is very expensive to manufacture, since the contacting of the electrodes must be undertaken galvanically on both sides of the piezo-ceramic. The conductive rubber, therefore, would have to be joined of two pieces and could only be conductive in specific regions.

The present invention overcomes these drawbacks in the prior art.

SUMMARY OF THE INVENTION

It is an objective of the present invention to overcome the drawbacks in the prior art discussed above by providing a bearing member which has the proper retention and elasticity while insuring that a reliable electrical contact is established with electrodes of the piezo-electric layer of the transducer.

The electro-acoustic transducer of the present invention has at least one bearing member which has at least one electrically conductive zone which is directly or indirectly in pressure contact with the electrodes of the piezo-electric layer on one side of the electrically conductive zone. The other side of the electrically conductive zone is pressure contacted to a means for establishing electrical conductivity on a housing part which supports the transducer. Other component electrical parts on the housing may then be attached thereto.

Accordingly, the bearing members remain unmodified in shape and elasticity. Only the electrically conductive zones which can be dimensioned extremely small have to be manufactured. The resonant behavior of the transducer plate, however, is not thereby influenced by these electrically conductive zones. It is desirable that the two electrically conductive zones formed on the bearing member press against small, electrically conductive bands which are connected to the electrodes of the piezo-electric layer. In this embodiment, no modification whatsoever of the transducer plate need be made. The small electrically conductive bands are merely cut to length such that they do not project beyond the edge of the transducer plate.

It is an advantage of the present invention that the bearing member is fashioned of one piece and is manufactured in a multiple-shock molding, because this type of manufacturing of the bearing member is extremely economical.

When the transducer plate is provided with a piezo-ceramic layer on only one side, it is expedient that the conductive rubber zones be formed by radially offset, electrically conductive regions in the bearing member.

In specific embodiments, for example, when a transducer has an integrated amplifier, the means for providing electrical conductivity may be composed of interconnects or of electrical lines.

In other specific embodiments, for example, when transducers without amplifiers utilize other separate electronic equipment, it is advantageous that the means for providing electrical conductivity be composed of electric plug elements. In this example, interconnects for other devices are thus eliminated, since the plug elements also serve for establishing electrical contacts exterior to the housing of the transducer.

BRIEF DESCRIPTION OF THE DRAWINGS

Features of the present invention which are believed to be novel, are set forth with particularity in the appended claims. The invention, together with further objects and advantages, may best be understood by reference to the following description taken in conjunction with the accompanying drawings, in the several figures of which like reference numerals identify like elements, and in which:

DESCRIPTION OF THE PREFERRED EMBODIMENT

Figure 1:
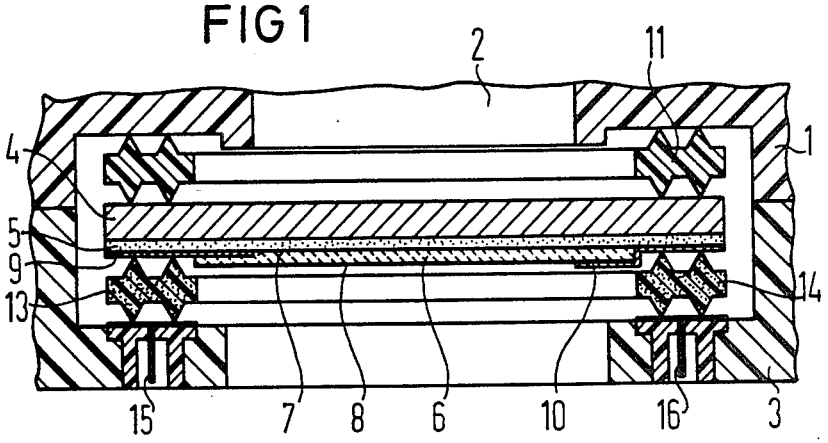
FIG. 1 is a cross-sectional view of the novel electro-acoustic transducer.

The present invention has general applicability but is especially useful in a transducer of the type shown in FIG. 1. The transducer of FIG. 1 has an upper housing part 1 which has a sound passage opening 2. The transducer also has a lower housing part 3 which is attached to the upper housing part 1 in any suitable manner. A transducer plate 4 is contained between the housing parts 1 and 3 and a piezo-ceramic layer 6 is attached to the transducer plate 4 by an adhesive layer 5. The piezo-ceramic layer 6 is provided with electrodes 7 and 8 on opposed sides thereof. Small electrically conductive bands 9 and 10 are connected to the electrodes 7 and 8, respectively. The bands 9 and 10 are small relative to the electrodes 7 and 8. The bands 9 and 10 do not extend beyond the edge of the transducer plate 4.

The transducer plate 4 is clamped between the housing parts 1 and 3 by elastic bearing members 11 and 12. As shown in FIG. 1, the piezo-ceramic layer 6 is attached to one side of the transducer plate 4. The bearing member 12 on this side of the transducer plate is provided with electrically conductive zones 13 and 14. See FIG. 2. These electrically conductive zones 13 and 14 press against the small bands 9 and 10, respectively, and the pressure established causes an electrical connection to be made therebetween. The electrically conductive zones 13 and 14 also press against plug elements 15 and 16 which are contained in the lower housing part 3. The electrical plugs 15 and 16 are in electrical contact with the electrically conductive zones 13 and 14 and provide an outside electrical connection for the transducer.

Figure 2:
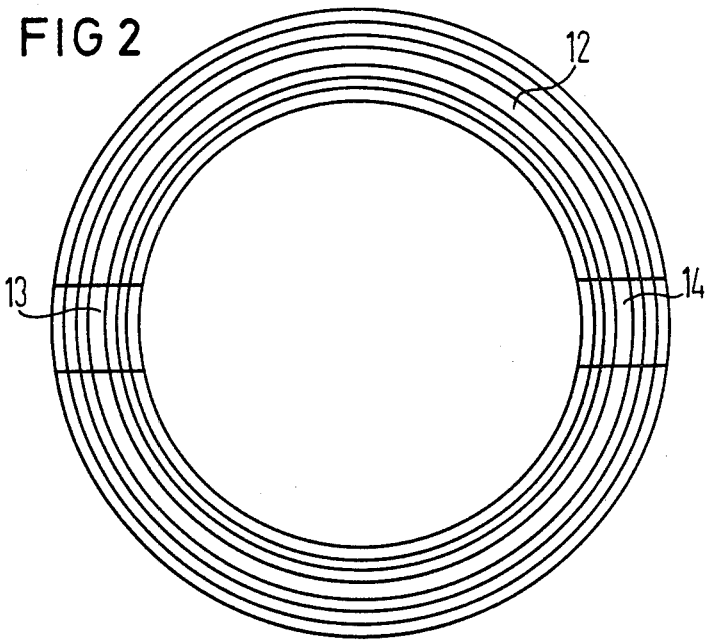
FIG. 2 is a plan view of a bearing member used in the FIG. 1 transducer.

In this embodiment, the bearing member 11 need not contain electrically conductive zones. However, it can be envisioned that for certain applications it may be desirable for the transducer plate to have piezo-electric layers on both sides. In such an embodiment, both bearing members would contain electrically conductive zones. Furthermore, the electrically conductive zones need be dimensioned only large enough to establish proper electrical connections. Also, although the preferred embodiment in FIG. 2 shows the electrically conductive zones 13 and 14 being radially opposed to one another on the bearing member 12, other locations on the bearing member 12 could be used.

The invention is not limited to the particular details of the apparatus depicted and other modifications and applications are contemplated. Certain other changes may be made in the above described apparatus without departing from the spirit and scope of the invention herein involved. It is intended, therefore, that the subject matter in the above depiction shall be interpreted as illustrative and not in a limiting sense.

We claim:

1. An electro-acoustic transducer having a piezo-electric layer applied to at least one side of a transducer plate and provided with at least two electrodes on opposed sides thereof, an annular edge region of the transducer plate free of the piezo-electric layer and clamped between bearing members contained in at least first and second housing parts, comprising:

at least one bearing member having two electrically conductive zones formed on said bearing member and pressure contacting first and second electrically conductive bands, respectively, said first and second bands electrically connected to the two electrodes, respectively, of the piezo-electric layer and pressure contacting means for providing electrical conductivity on one of the housing parts;

wherein said means for providing electrical conductivity is connected to other component parts.

2. The electro-acoustic transducer described in claim 1, wherein said electrically conductive zones comprise radially offset, electrically conductive regions of said bearing member.

3. An electro-acoustic transducer comprising:

substantially circular transducer plate;

piezo-electric layer applied to at least one side of said transducer plate, an annular edge region of said transducer plate free of said piezo-electric layer;

at least first and second electrodes attached to opposed sides of said piezo-electric layer and first and second electrically conductive bands connected to said first and second electrodes, respectively, and both electrically conductive bands extending onto said annular edge region of said transducer plate at two different predetermined locations;

at least one bearing member having at least first and second electrically conductive zones in said bearing member in pressure contact with said first and second electrically conductive bands, respectively.

4. The electro-acoustic transducer described in claim 3, wherein said bearing member is in pressure contact with at least a portion of said annular edge region of said transducer plate.

5. The electro-acoustic transducer described in claim 4, wherein said bearing member is substantially circular and has at least two concentric ribs for pressure contacting said annular edge region of said transducer plate.

6. The electro-acoustic transducer described in claim 4, wherein said bearing member is a single piece construction.

7. The electro-acoustic transducer described in claim 4, wherein said electro-acoustic transducer further comprises a second bearing member in pressure contact with said transducer plate on a side of said transducer plate opposite said first bearing member.

8. The electro-acoustic transducer described in claim 7, wherein said electro-acoustic transducer further comprises at least first and second housing parts for containing both of said bearing members under pressure contact with said transducer plate.

9. The electro-acoustic transducer described in claim 8, wherein said first housing part has at least first and second means for providing electrical conductivity pressure contacted to said first and second electrically conductive zones, respectively, of said first bearing member.

10. The electro-acoustic transducer described in claim 7, wherein both of said bearing members are substantially circular and each of said bearing members has at least two concentric ribs, one of said bearing members located on one side of said transducer plate and the other of said bearing members located on the other side of said transducer plate and pressure contacting opposite sides of said annular edge region of said transducer plate.

11. The electro-acoustic transducer described in claim 10, wherein each of said bearing members is a single piece construction.

12. An electro-acoustic transducer comprising:

substantially circular transducer plate;

piezo-electric layer applied to at least one side of said transducer plate, an annular edge region of said transducer plate free of said piezo-electric layer;

first and second electrodes attached to opposed sides of said piezo-electric layer;

first and second electrically conductive bands connected to said first and second electrodes, respectively, and each of said electrically conductive bands extending onto said annular edge region of said transducer plate;

first and second bearing members in pressure contact with opposed sides of said annular edge region of said transducer plate, said first bearing member having first and second electrically conductive zones in pressure contact with said first and second electrically conductive bands, respectively;

at least first and second housing parts for containing both of said first and second bearing members under pressure contact with said transducer plate;

first and second means for providing electrical conductivity on said first housing part and pressure contacted with said first and second electrically conductive zones, respectively, of said first bearing member.

13. The electro-acoustic transducer described in claim 12, wherein said first and second electrically conductive zones are formed by radially opposed, electrically conductive regions of said first bearing member.

14. Electro-acoustic transducer described in claim 12, wherein each of said means for providing electrical conductivity are electrical plug elements.

* * * * *